United States Patent [19]

Appel et al.

[11] Patent Number: 4,466,897

[45] Date of Patent: Aug. 21, 1984

[54] PROCESS FOR THE MANUFACTURE OF SOAP POWDER

[75] Inventors: Peter W. Appel, Vlaardingen; Robert D. Den Outer, Rotterdam; Klaas Schutter, Vlaardingen; Johan C. P. Broekhoff, Schiedam, all of Netherlands

[73] Assignee: Lever Brothers Company, New York, N.Y.

[21] Appl. No.: 421,659

[22] Filed: Sep. 22, 1982

[30] Foreign Application Priority Data

Sep. 29, 1981 [GB] United Kingdom ..... 8129409

[51] Int. Cl.[3] ..... C11D 9/10; C11D 9/12; C11D 9/14; C11D 11/02

[52] U.S. Cl. ..... 252/108; 252/109; 252/133; 252/134; 252/174.14; 252/368; 252/370; 427/212

[58] Field of Search ..... 252/108, 109, 110, 133, 252/134, 174.14, 368, 370; 427/212

[56] References Cited

U.S. PATENT DOCUMENTS

| | | | |
|---|---|---|---|
| 2,423,451 | 7/1947 | Holuba | 252/109 |
| 2,592,535 | 4/1952 | Bodman | 260/398.5 |
| 2,940,935 | 6/1960 | Reich | 252/109 |

FOREIGN PATENT DOCUMENTS

| | | | |
|---|---|---|---|
| 907494 | 10/1962 | United Kingdom | 252/132 |

*Primary Examiner*—Dennis L. Albrecht
*Attorney, Agent, or Firm*—James J. Farrell

[57] ABSTRACT

A process for making washing powder having a high content of sodium soap in which the tendency to form clots and gels is reduced. The reduction is effected by impregnating spray-dried or spray-cooled powder with a specified amount of a water-soluble sodium salt. The amount specified is sufficient to produce a solution of sodium ions having 0.5 to 4 molar initial concentration in the immediate locality of the individual spray-dried particles.

3 Claims, No Drawings

PROCESS FOR THE MANUFACTURE OF SOAP POWDER

This invention relates to the production of washing powders containing substantial proportions of soap.

Washing powders containing substantial proportions of soap are quite popular in some countries, where they are used largely for washing clothes by hand or in non-automatic washing machines of the single tub or twin-tub type. Although powders based on soap generally have good dissolving properties at the normal wash temperature of 40° C. and above, great care must be exercised when adding them to water to prevent clots of soap gels being formed. Such clots are unsightly and can take a considerable time to dissolve so that there is a danger of their being left behind on the washed clothes.

This invention is concerned with the production of washing powders containing substantial proportions of soap which have a reduced tendency to the formation of clots and gels.

The clotting problem with washing powders containing substantial proportions of soap (which will hereafter be referred to, for convenience, as 'soap powders') is not a new one. It is referred to in British Pat. No. 907,494, in which it is proposed to reduce clotting, and also lumping in the pack with a mixture of borax and sodium acetate or sodium benzoate, the two components being added as granular solids. U.S. Pat. No. 2,940,935 also deals with the clotting problem. In this reference it is approached by the incorporation of an alkali metal xylene sulphonate and an alkali metal silicate or carbonate into the crutcher slurry prior to spray-drying.

We have now discovered that clotting of soap powders can be considerably reduced by impregnating or co-granulating the individual powder particles with a finely divided sodium salt in a defined amount.

Accordingly, the present invention provides a process for the production of a washing powder comprising a sodium soap as the sole or principal organic detergent-active species which comprises spray-drying or spray-cooling an aqueous slurry comprising the soap and other fabric washing powder components to form spray-dried washing powder particles, characterised in that the powder particles are impregnated or co-granulated with a finely divided, readily water-soluble sodium salt in an amount sufficient to produce a solution of sodium ions having 0.5 to 4 molar initial concentration in the immediate locality of the individual spray-dried particles on addition of the powder to water.

The preferred way of impregnating the powder particles with a finely divided sodium salt is to spray them with a solution, usually an aqueous solution, of the salt. This may be done as the powder passes a spraying station on a conveyor belt, or as it falls from one level in the factory to another, for instance as it falls from one conveyor belt to another.

Co-granulation of the powder particles with the salt may be carried out in any of the conventional granulation apparatus, for example fluidised beds, pan granulators or mixers such as the Schugi (registered trade mark) mixer.

It is most convenient, in order to meet the criterion that the sodium ion concentration in the immediate locality of the individual spray-dried particles should be from 0.5 to 4 moles/liter, if a sodium salt is used which contains a relatively high percentage of sodium. Sodium chloride, sodium carbonate and alkaline sodium silicate are examples of such salts, each of them having a sodium content of greater than 35% by weight. Salts having at least that amount of sodium in the molecule are preferred. Another factor which is important in the choice of a sodium salt is its water solubility. Sodium chloride sodium hexametaphosphate and sodium carbonate are quite readily soluble, and they are also preferred for that reason.

Generally, it is preferred to use a sodium salt which has a water solubility of greater than 20 g/l at 0° C.

Although the sodium concentration of the solution in the immediate locality of the spray-dried powder particles is the governing factor in determining the amount of sodium salt with which the powder is impreganted or co-granulated, in the case of impregnation by spraying the amount is 25 roughly expressed by the following rule; that the weight percentage of the sodium salt, based on the weight of the powder, which is sprayed onto the powder is according to the equation $$\text{Weight percentage sprayed on} = \frac{100 - 1000}{\text{Weight percentage of sodium in the salt}}$$

In order to discover whether an amount of sodium salt in accordance with the invention is impregnated on the powder the following simple test is performed:

The wetting behaviour of the powder under test is assessed by the following general procedure:

A clear plastic bowl is graduated at a content of 5 liters and filled to the graduation with water of 15° French hardness at a temperature of 45° C.

30 gms of the powder to be tested are poured onto the surface of the water during a five second period and after a further five seconds the volume of powder remaining unwetted on the surface is estimated. The water is then agitated and the time noted for any clots formed to break-up and dissolve. The time to complete dissolution of the powder is also noted.

The volume of powder remaining unwetted, the time taken for any clots to disappear and the time taken for complete dissolution were each rated on a scale of 0 to 5.

This test is performed three times, once by each of the separate testers, on each powder which was assessed.

The procedure for determining whether a given powder is or is not in accordance with the invention is to assess (a) untreated soap powder as produced from the spray-drying spray-cooling tower, (b) the treated soap powder under test and (c) untreated powder poured not onto water but onto a series of solutions of sodium ion of increasing concentration. In this way, by comparing the results of procedure (a) with those of (c), it can be seen what is the optimum wetting behaviour which can be achieved, and by comparing procedure (b) with (c) it can be seen how close to the optimum the powder under test is.

The soap powder produced by the process of the invention contains a sodium soap, possibly in combination with soaps of other cations, as the principal organic detergent active species. The sodium soap will be present in an amount of from 20 to 100% by weight of the spray-dried powder, which itself will comprise from 15 to 100% of the finished powder.

In addition to soap, other organic detergent-active species may be present. For example, anionic surfactants such as sodium alkyl benzene sulphonate, nonionic surfactants such as $C_{4-24}$ primary and secondary alcohols ethoxylated with from 3–25 moles of ethylene oxide per mole of alcohol, and cationic surfactants such as $C_{1-24}$ alkyltrimethyl ammonium halides may be used.

The $C_{8-24}$ fatty acids from which the soaps are prepared may be derived, for example, from nut oils such as coconut oil or palm kernel oil or from tallow class fats, such as beef and mutton tallows, palm oil, lard, some vegetable butters, castor oil and rape see oil. The longer carbon chain length material such as the castor oil, the tallow class fat and the rape see oil, may be hardened, if desired, so as to decrease the content of unsaturated acids such as oleic acid and linoleic acid.

It is preferred to use mixtures of soaps derived from tallow class fats ($C_{14-20}$, mainly $C_{18}$ fatty acids) and soaps from soft oils and nut oils, which are predominantly $C_{10-14}$, mainly $C_{12}$ fatty acids, of which normally at least 75% are saturated. In general, the nut oils contribute the lower carbon chain length soaps which improve the solubility of the soap. However, the nuts oils are generally more expensive than the tallow class oils and so it is desirable to reduce their inclusion to the minimum that is compatible with good solubility. Typical mixtures consist of from 9 parts tallow class fat to 1 part nut oil soap, to equal parts of each.

The soap powder of the invention may also contain a detergency builder compound. Any detergency builder may be used, either a phosphate-based builder such as sodium tripolyphosphate, sodium pyrophosphate or sodium orthophosphate, or a mixture thereof, or any one of the compounds which has been suggested recently as a result of pressure from those wishing to reduce phosphate contents of effluents. Typical of these are sodium citrate, aluminosilicates, both crystalline and amorphous, and a host of organic chelating compounds, prominent amongst which are nitrilotriacetic acid, which has been used commercially in some countries, alkenyl succinate salts and salts of carboxymethyloxysuccinic acid. These detergency builder compounds can be used in any desired combination so that the desired calcium/magnesium building capacity is achieved at the level of phosphorous, if any, which is permitted or required.

Although some of these compounds are sodium salts, they will not be present in a state which renders them sufficiently readily soluble to affect the dissolution properties of soap powders as described herein.

Bearing in mind that soap formulations are to a large extent self-building, the amount of detergency builder compound required will normally be between 5 and 25% by weight of the whole powder formulation when the amount of soap is between 20 and 60% by weight, as is preferred.

The soap powders of the invention may contain other materials in conventional amounts. For example, they may contain a bleaching material, either an oxygen bleach such as sodium perborate or sodium percarbonate, or a chlorine bleach such as sodium di- or trichloroisocyanurate, or mixtures thereof. These materials may be present in amounts of from 10 to 30% by weight of the powder, preferably 15 to 25%, when the bleaching material is sodium perborate or sodium percarbonate and from 5 to 20% by weight when it is a chlorine bleach such as sodium dichloroisocyanurate.

Anti-redeposition agents, such as sodium carboxymethyl cellulose, fillers such as sodium sulphate, corrosion inhibitors such as sodium silicate, optical brightening agents, coloured speckles and perfumes, may also be present in amounts varying from 0.1 to 5% by weight. Moisture may be present in an amount of up to 15%.

EXAMPLE

In a series of experiments a spray-dried washing powder having the formulation shown below was formed into a cylindrical bed by placing it in a cylindrical container fitted with a water-permeable base. The container was attached to an automatically recording gravimetric balance so that its change in weight with time could be plotted continuously. The container was then positioned so that the water-permeable base was just touching the surface of a body of water or an aqueous solution of a salt at a temperature of 45° C. and the rate of uptake of water or solution and the final total uptake was recorded via the balance. The results are shown in Table 1.

TABLE 1

Uptake of salt solution by a bed of powder as a function of sodium concentration (moles/liters)

| | Sodium Concentration (moles/liters) | | | | | | | | | |
|---|---|---|---|---|---|---|---|---|---|---|
| Salt | 0.0001 | 0.01 | 0.1 | 0.25 | 0.5 | 1.0 | 2.0 | 4.0 | 5.0 | 6.0 |
| Sodium chloride | 2.3 | 2.3 | 2.0 | 0.7 | 0.7 | 10.2 | 8.5 | 1.5 | 0 | 0 |
| Sodium carbonate | 2.8 | 2.8 | 2.8 | 1.0 | 0.8 | 0.9 | 8.5 | 9.2 | 7.5 | 4.7 |
| Sodium tetraborate | 2.9 | 2.9 | 2.2 | 1.3 | 1.2 | * | * | * | * | * |
| Sodium hexametaphosphate | 3.0 | 3.0 | 3.0 | 2.7 | 2.2 | 6.3 | 7.3 | 7.0 | 2.0 | — |
| Sodium sulphate | 2.8 | 2.8 | 2.2 | 1.3 | 3.6 | 9.5 | 10.0 | 8.7 | 8.4 | — |

The spray-dried soap powder on which the above experiment was performed had the following formulation:

| Component | % by weight |
|---|---|
| Sodium soap (80:20) coconut/tallow) | 74.1 |
| Coconut monoethanolamide | 3.8 |
| Moisture and minor components | 9.2 |

It can be seen from the table that the uptake of water by the bed of powder passes through a maximum in the region where the sodium ion concentration of the salt solution is in the 0.5 to 4.0 moles/liter area. We have good reasons for believing that uptake of water correlates well with wetting of the powder, a high uptake correlating with quick wetting. Therefore, when a spray-dried soap powder is impregnated with an amount of a sodium salt which corresponds with an amount which produces a concentration of from 0.5 to 5 moles/liter of sodium under the conditions of our test, a quick wetting powder is produced.

In the case of sodium tetraborate, the solubility of the salt is too low and also its sodium content is too low to allow the advantageous concentration of sodium ion to be reached.

We claim:

1. A process for the production of a washing powder containing a sodium soap as the sole or principal organic detergent-active species, comprising: spray-drying or spray-cooling an aqueous slurry containing the soap and other fabric washing powder components to form spray-dried washing powder particles, and impregnating or co-granulating said particles with finely divided sodium carbonate in an amount sufficient to produce a solution of sodium ions having 0.5 to 4 molar initial concentration in the immediate locality of the individual spray-dried/spray-cooled particles on addition of the powder to water.

2. A process according to claim 1 wherein said impregnating is accomplished by spraying said powder particles with an aqueous solution of the sodium carbonate.

3. A process according to claim 1 wherein the sodium soap is present in an amount of from 20 to 100% by weight of the spray-dried powder.

* * * * *